United States Patent [19]

Feldmann et al.

[11] Patent Number: 4,479,374

[45] Date of Patent: Oct. 30, 1984

[54] STRIP-ROLLING METHOD AND APPARATUS

[75] Inventors: Hugo Feldmann, Alsdorf; Karl Illert, Neuss; Willi Benz, Neuss; Heinrich Bohnenkamp, Neuss, all of Fed. Rep. of Germany

[73] Assignee: SMS Schloemann-Siemag AG, Düsseldorf, Fed. Rep. of Germany

[21] Appl. No.: 469,137

[22] Filed: Feb. 23, 1983

[30] Foreign Application Priority Data

Feb. 24, 1982 [DE] Fed. Rep. of Germany ..... 3206556
Jun. 21, 1982 [DE] Fed. Rep. of Germany ..... 3223099

[51] Int. Cl.[3] ..... B21B 28/04

[52] U.S. Cl. ..... 72/236; 72/241; 72/234; 29/33.5

[58] Field of Search ..... 72/199, 234, 236, 365, 72/366; 29/148.4 D, 33.5, 56.5; 51/262 A; 409/137, 136

[56] References Cited

U.S. PATENT DOCUMENTS 861,981 7/1907 Hill ..... 72/236
1,086,806 2/1914 Collins ..... 72/236
3,322,037 5/1967 Cavagnero ..... 409/137

FOREIGN PATENT DOCUMENTS 0044715 1/1982 European Pat. Off. .
955131 12/1956 Fed. Rep. of Germany .
1037804 8/1958 Fed. Rep. of Germany .
2206912 8/1972 Fed. Rep. of Germany .
2835514 1/1980 Fed. Rep. of Germany .
82150 7/1981 Japan ..... 409/136

*Primary Examiner*—Lowell A. Larson
*Assistant Examiner*—Jorji M. Griffin
*Attorney, Agent, or Firm*—Karl F. Ross; Herbert Dubno

[57] ABSTRACT

A rolling stand includes a frame and a pair of working rolls mounted on the frame centered on and rotatable about respective parallel axes and defining a nip so that a strip can pass in each of a succession of passes forming a single run through the nip so that with each pass the thickness and width of the strip are reduced. The ends of the working rolls project laterally beyond the longitudinal edges of the strip. Respective backing rolls mounted on the frame extending generally the full length of the working rolls are braced toward the nip against the working rolls to urge same against the strip. Tools displaceably mounted on the frame reduce the diameters of the projecting ends of the working rolls several times after respective passes during a single run so that the working rolls only contact the respective backing rolls along a diatance equal generally to the workpiece width. The tools are lathe-type tool bits and respective holders juxtaposed with the end regions and rotatable about respective axes parallel to the respective working-roll axis each carry a plurality of radially projecting and radially and angularly spaced such tools. The holders can be angularly stepped to bring successive tools into engagement with the respective end regions. These holders of each roll are coaxial and axially oppositely displaceable.

9 Claims, 22 Drawing Figures

STRIP-ROLLING METHOD AND APPARATUS

FIELD OF THE INVENTION

The present invention relates to a method of and apparatus for rolling a metal strip. More particularly this invention concerns the multipass production of metallic strip in a rolling mill.

BACKGROUND OF THE INVENTION

Thick and wide strip material, e.g. steel strip, is reduced to the desired dimensions and its strength and flexibility are enormously increased by subjecting it to a plurality of plastic-working operations, normally by moving it in a run consisting of a multiplicity of passes between rolls that compress it with great force. Such action, combined with some tension in the strip, decreases the workpiece thickness (its smallest dimension as compared to its length which extends in the travel direction and its width which is perpendicular thereto and to the compression direction) and its width, while increasing the length of the strip workpiece. Thus the workpiece travel speed increases slightly with each pass between the rolls.

The rolling is done in roll stands each comprising two parallel and small-diameter working rolls that define a nip through which the strip passes. A pair of much larger-diameter backing rolls flanks these working rolls, each backing roll engaging the respective working roll in line contact and urging it toward the other working roll. Thus the working rolls can exert enormous pressures on the workpiece because of the small contact area between them. The natural tendency of this force to bend these small-diameter working rolls outwardly away from the workpiece is countered by the stiffer large-diameter backing rolls. In addition complex systems are provided to oppositely bend the backing and working rolls so they are convex toward the workpiece to substantially eliminate any bend in the working rolls.

The workpiece width is invariably smaller than the effective width of the rolls, which are cylindrical with stub shafts on their ends so this effective width is the length of the middle largest-diameter cylindrical portion. The contact width, that is the length of the contact zone between the workpiece and the working rolls measured parallel to the roll rotation axes which are in a plane perpendicular to the workpiece travel direction, is generally equal to slightly less than the effective width for the first pass, which may include several passages through a given roll stand, and is a small fraction of this effective width for the last pass. Thus, in addition to bending, the working rolls are subject to limited elastic deformation in the form of a flattening in the region of contact with the workpiece. The out-of-contact end portions of the two working rolls are not flattened, but are cylindrical, so the nip between the working rolls is slightly smaller to both sides of the workpiece than at the workpiece. As a result the strip edges are subjected to greater pressure and are flattened, a phenomenon known as edge drop. Thus the strip workpiece is not of uniform thickness.

To overcome this problem the above-mentioned roll-bending equipment is used to bring pressure on the working-roll ends. Obtaining enough bend to cancel out the above-described flattening of the rolls is very difficult.

In addition it is known to make the working rolls slightly barrel shaped so that when they bend their side in contact with the workpiece becomes perfectly straight. The problem with this type of arrangement is that the rolls then are only suitable for use for a limited range of workpiece widths, needing complex remachining for different sizes.

In another known system, such as described in German patent document Nos. 955,131 and 2,206,912 the working rolls are braced against outwardly tapered or barrelf-shaped intermediate backing rolls in turn backed up by cylindrical rolls. The frustoconically tapered end regions of the intermediate backing rolls start about level with the strip edges. Thus as band width changes the intermediate backing rolls must be changed also, necessitating the use of complex supports for the rolls as well as a magazine of different roll sides.

A solution to this problem has been the use of intermediate backing rolls which each have only one tapered end region and which can be moved axially in the roll stand. The edge of this end region is aligned vertically with a respective workpiece edge, and is moved in as the rolling operation progresses and the workpiece becomes narrower. Obviously the equipment that does this is extremely complex, expensive, and difficult to operate. In addition such uneven bending of the working rolls creates a workpiece of nonuniform thickness in its central regions. The working rolls in such a system also wear at an excessively fast rate.

OBJECTS OF THE INVENTION

It is therefore an object of the present invention to provide an improved roll stand and method of operating same.

Another object is the provision of such a roll stand and method of operating same which overcome the above-given disadvantages.

Yet another object is the provision of a rolling method and apparatus which make it relatively easy to produce a strip of perfectly uniform thickness.

SUMMARY OF THE INVENTION

These objects are attained according to the instant invention in a rolling method of the standard type, that is wherein in each of a succession of passes forming a single run a strip travels through a nip defined between a pair of parallel and nearly cylindrical working rolls braced against respective backing rolls so that with each pass the thickness and width of the strip are reduced and wherein the ends of the working rolls project laterally beyond the longitudinal edges of the strip. According to this invention the diameters of the projecting ends of the working rolls are reduced by removal of material from them several times after respective passes in a single run so that the working rolls only contact the respective backing rolls along a distance equal generally to the workpiece width.

As discussed above, the decrease in effective roll width as the workpiece width decreases during a run takes the end portions of the working rolls out of contact with the backing rolls. The center portions of the working rolls are meanwhile flattened somewhat both on the side in contact with the workpiece and diametrally opposite thereto on the side in contact with the respective backing rolls. The end region of each working roll is not in contact with the workpiece, however, so it is not flattened on this side. Similarly since these end regions are of smaller diameter than the rest of the central part of the rolls they do not touch the backing rolls either and are not flattened on this side. If these end regions were not cut away they would contact the backing rolls which would therefore bow the working rolls somewhat toward each other, causing excessive flattening of the workpiece at the edge, so-called edge drop. Periodically reducing the effective width of the working rolls symmetrically to a central plane longitudinally bisecting the workpiece and perpendicular to the working-roll axes according to this invention eliminates this effect. In use the working rolls might still bend slightly and contact the backihg rolls at their cut-in end regions, but even so the finished workpiece will exhibit virtually no edge drop.

The instant invention is feasible because it is standard practice to change and machine the working rolls frequently in a rolling mill to make these rolls smooth as they get scarred in use. When rolling hot they are changed at least twice a day and when rolling cold they are changed two to three times per shift. Exchange rolls may be provided, or the rolls can be sent to a shop which turns and/or grinds them down somewhat. This machining-down of the rolls is only done between runs, that is after one or more workpieces are completely rolled out to the desired size. Hot-rolling rolls are reduced by between 0.5 mm and 1.0 mm and cold-rolling rolls by at most 0.5 mm. According to this invention, however, the rolls are machined several times during a single such run on their projecting ends only so each time the effective width of the rolls is reduced to be generally equal to the contact width, which is the workpiece width. Thus with this system at the end of a run all that need be machined is the normally somewhat scarred central portion of the working rolls, since the projecting end portions have already been cut. In effect, therefore, the rolls are machined down as before, but this machining is done in several stages, each of which reduces the diameter on two annular strips, until all that. is left is a central projecting region having an axial dimension roughly equal to that of the finished workpece strip.

According to this invention the rolls are mounted on a stationary roll stand for rotation about respective parallel axes as the strip passes between them, as is known. With the invention system the diameters of the working rolls are reduced by machining of the working rolls while same rotate about their axes on the roll stand, that is without removing them, so the system does not appreciably slow the rolling run. In addition according to the invention such machining can be done while the working rolls are in contact with the strip in the nip, that is during the rolling operation. The ends are machined down symmetrically to a central plane perpendicular to the roll axes and bisecting the rolls and workpiece.

The ends according to this invention can be machined by means of laser beams directed at the working rolls to vaporize the surfaces of the projecting ends thereof. The energy and movement of the beams is controlled to determine the depth and width of cut. This procedure is particularly suited for retrofitting on an existing piece of equipment.

In accordance with yet another feature of the invention the ends are machined by engaging a hard material-removing tool against them. This tool is moved radially against the rolls and then axially along the projecting-end region whose diameter is to be reduced. Thus the ends are machined to cylindrical shape and after each run the central region of each roll between the machined-down end regions is machined down to the same diameter as the end regions.

To this end, according to this invention, the roll stand is provided adjacent each projecting end with a tool holder rotatable about an axis parallel to the respective working-roll axis and provided with a plurality of axially and radially spaced tools. Each end is machined by engagement with one of the respective tools. The holders are rotated between machining operations to bring successive tools into engagement with the respective end regions.

The rolling stand according to this invention therefore includes a frame and a pair of working rolls mounted on the frame centered on and rotatable about respective parallel axes and defining a nip so that a strip can pass in each of a succession of passes forming a single run through the nip so that with each pass the thickness and width of the strip are reduced. The ends of the working rolls project laterally beyond the longitudinal edges of the strip. Respective backing rolls mounted on the frame extending generally the full length of the working rolls are braced toward the nip against the working rolls to urge same against the strip. Machining means mounted on the frame reduces the diameters of the projecting ends of the working rolls several times after respective passes during a single run so that the working rolls only contact the respective backing rolls along a distance equal generally to the workpiece width.

This machining means can include respective laser units directed at the end regions. It can also have respective tools radially engageable with the end regions. Two such tools can be provided, one engageable simultaneously with the end regions at one end of the working rolls and the other at the other end for simultaneous machining of two end regions by each tool. In any case means is provided for displacing the tools radially and axially of the respective working rolls. The tools are lathe-type tool bits. Respective holders juxtaposed with the end regions and rotatable about respective axes parallel to the respective working-roll axis each carry a plurality of radially projecting and radially and angularly spaced such tools. The holders can be angularly stepped to bring successive tools into engagement with the respective end regions. These holders of each roll are coaxial and axially oppositely displaceable.

According to another feature of this invention means is provided for removing chips from the working rolls adjacent the tool. This means includes a compressed-gas jet directed generally parallel to the respective working-roll axis outward at the tool. It may also have respective liquid sprayers directed at the working rolls and respective scrapers engaging the working rolls.

It is also within the scope of this invention for the tool to be a grinding wheel and the machining means to include means for rotating the wheel.

DESCRIPTION OF THE DRAWING

The above and other features and advantages will become more readily apparent from the following, reference being made to the accompanying drawing in which.

SPECIFIC DESCRIPTION

Figure 1A:
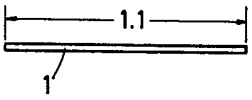
FIGS. 1*a*, 1*b*, 1*c*, 1*d*, and 1*f* are end views of the workpiece after successive rollings according to this invention.
Figure 2A:
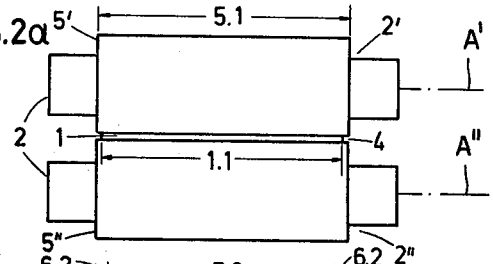
FIGS. 2*a*, 2*b*, 2*c*, 2*d*, and 2*f* are end views of the working rolls for the workpiece as shown respectively in FIGS. 1*a*, 1*b*, 1*c*, 1*d*, and 1*f*.
Figure 1B:
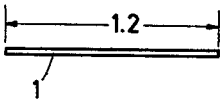
Figure 2B:
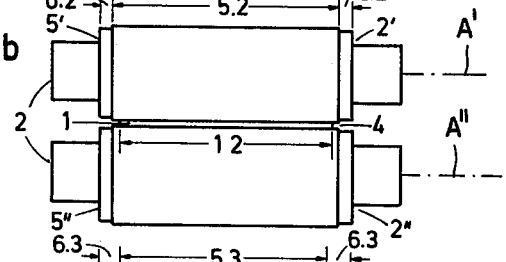
Figure 1C:
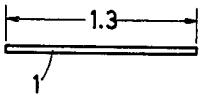
Figure 2C:
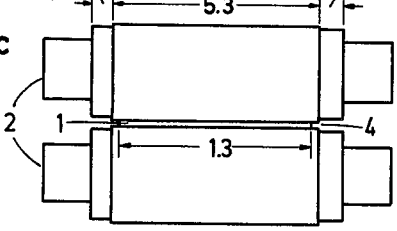
Figure 1D:
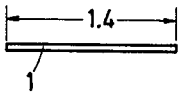
Figure 2D:
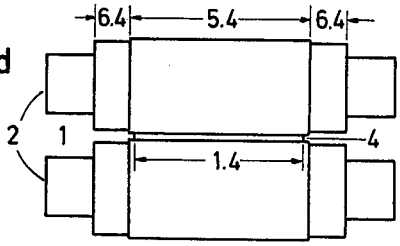
Figure 1E:
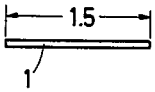
Figure 2E:
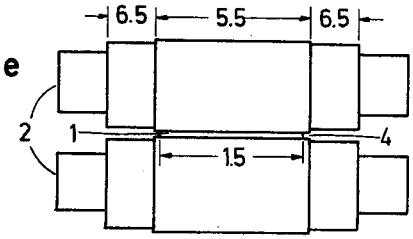

As seen in FIGS. 1a–1e the instant invention is aimed at a method and apparatus for rolling out a strip workpiece 1 whose starting width is 1.1 as seen in FIG. 1a, and which with successive passes is reduced through widths 1.2, 1.3, and 1.4 to a final width of 1.5, respectively shown in FIGS 1b, 1c, 1d, and 1e. This width reduction is accompanied by a thickness reduction, that is a reduction in an up-and-down direction as seen in the drawing.

Such width reduction is effected by a pair 2 of rolls 2′ and 2″ rotatable about parallel horizontal axes A′ and A″ and defining a horizontally throughgoing slot or nip 4. The rolls 2′ and 2″ have central portions 5′ and 5″ which to start with, that is when the workpiece 1 with its original width 1.1 is being rolled, have an effective length 5.1 which is slightly greater than the workpiece width 1.1.

After the first pass or passes according to the invention, that is once the workpiece width is reduced from width 1.1 to width 1.2, the central portions 5′ and 5″ are machined down to have an effective width 5.2 equal to less than the effective width 5.1 but slightly more than the workpiece width 1.2. This leaves projecting end portions 6.2 that are out of engagement with the workpiece 1 altogether. It is these projecting end portions 6.2 that have been machined down according to this invention, that is the roll diameter has been reduced at them.

Subsequently as the workpiece width decreases to widths 1.3, 1.4, and 1.5, the effective roll width is reduced to widths 5.3, 5.4, and 5.5, by machining of ever widening projecting end regions 6.3, 6.4, and 6.5. In fact all that is machined down between passes is a bit more of each end region, enough to increase the end-region length to the desired extent so the remaining central portion has a length equal generally to the workpiece width.

Figure 3:
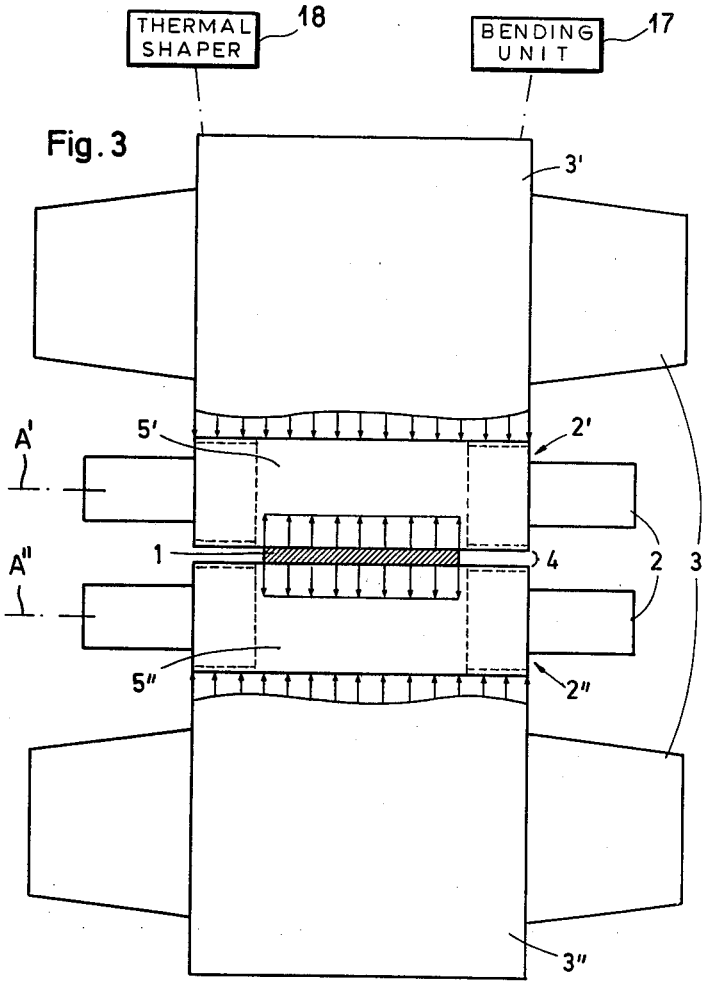
FIG. 3 is a large-scale end view of a roll stand of the type having the working rolls of FIGS. 2a–2f.

As better shown in FIG. 3 the roll pair 2 is backed up by a pair 3 of large-diameter backing rolls 3′ and 3″ rotatable about respective parallel axes parallel to and coplanar with the axes A′ and A″. Further backing rolls could be used without departing from the instant invention, so long as the one or more backing rolls in direct contact with each working roll have an axial length equal at least to the width 1.1, that is so that at the start of each run the rolls engage each other along a line whose length is at least equal to the width 1.1.

Thus the decrease in effective roll width as the workpiece width decreases during a run takes the end portions 6.2–6.3 out of contact with the backing rolls 3′ and 3″. The center portions of the rolls 5′ and 5″ are meanwhile flattened somewhat both on the side in contact with the workpiece 1 and diametrally opposite thereto on the side in contact with the respective backing rolls 3′ and 3″. The end region of each working roll 5′ and 5″ is not in contact with the workpiece 1, however, so it is not flattened on this side. Similarly since these end regions are of smaller diameter than the rest of the central part of the rolls they do not touch the backing rolls either and are not flattened on this side. If these end regions were not cut away they would contact the backing rolls which would therefore bow the working rolls somewhat toward each other, causing excessive flattening of the workpiece at the edge, so-called edge drop. Periodically reducing the effective width of the working rolls symmetrically to a central plane longitudinally bisecting the workpiece and perpendicular to the working-roll axes according to this invention eliminates this effect.

Of course the backing rolls could be cut down instead for the same effect and advantages, but since these backing rolls only need occasional machining whereas the working rolls need frequent machining, it is more practical to machine the working rolls. In fact with the system of this invention, with at most a modest machining of the working rolls after each pass of the workpiece through them, it is possible to reduce the machining needed at the end of the operation considerably. This final machining after the run to return to maximum working-roll width can also be carried out according to this invention without taking the working rolls out of the roll frame.

Figure 4:
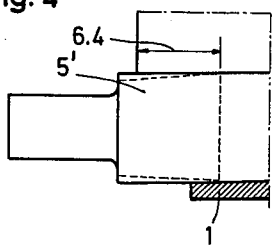
FIGS. 4 and 5 are detail views illustrating ends of the working rolls according to this invention.
Figure 5:
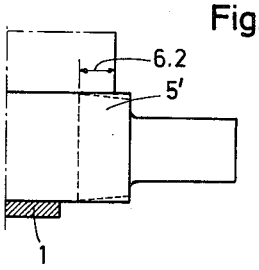

According to this invention the workpiece diameter is reduced by between 0.1 mm and 1.8 mm, preferably between 0.2 mm and 1.0 mm, at the end regions. The effective width of the rolls can be reduced to less than that of the workpiece 1, as is shown for the end region 6.4 of the roll 5 in FIG. 4. It is also possible to reduce the effective working-roll width so it is greater than the workpiece width, as shown at 6.2 in FIG. 5 for roll 5′. Both procedures lie within the scope of this invention, so long as the end-region width is increased regularly within a single run as the workpiece width decreases. In addition FIGS. 4 and 5 indicate that the cut-in end regions can be of frustoconical shape, rather than cylindrical as shown in FIGS. 2a–2e. The cone angle relative to the working-roll axis decreases as the width of the cut-in end regions increases.

The system according to this invention is provided with a bending arrangement indicated diagrammatically at 17 which detects bending of the working rolls and institutes an end-region width increase when excessive bending is detected. In addition a thermal roll-shaping unit shown schematically at 18 can be associated with the rolls to vary their shapes somewhat from the cylindrical, or to return them to the cylindrical as needed.

Figure 6:
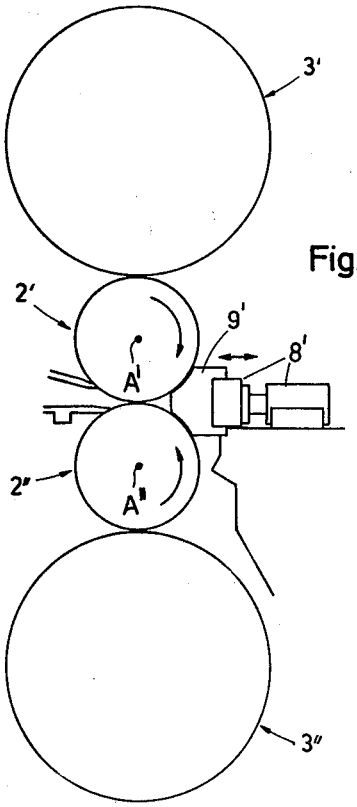
FIG. 6 is a side view of the roll stand according to FIG. 3.
Figure 7:
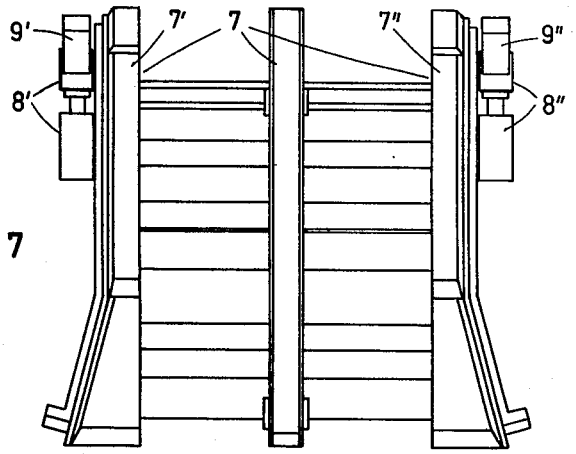
FIG. 7 is a small scale end view of the stand of FIGS. 3 and 6.

FIGS. 6 and 7 show how the roll frame 7 in which the rolls are journaled has two sides 7′ and 7″ carrying respective hard material-removing tools 9′ and 9″ and respective actuators 8′ and 8″ which can move these tools 9′ and 9″ both perpendicular to the plane of the axes A′ and A″ and parallel to these axes for machining down the working-roll end regions. Each such tool 9′ and 9″ machines two end regions at the same time.

These tools are hard lathe-type cutting bits capable of machining the hard steel working rolls.

Figure 8:
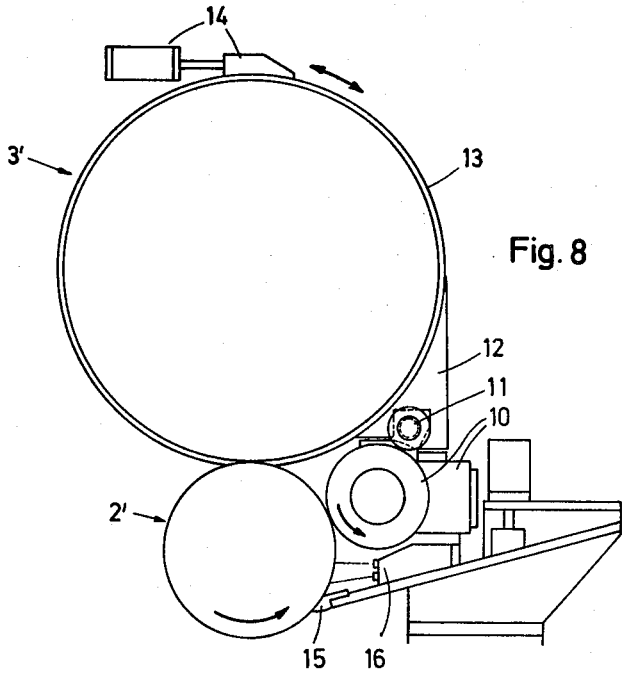
FIG. 8 is a large-scale side view of a detail of another stand according to this invention.
Figure 9:
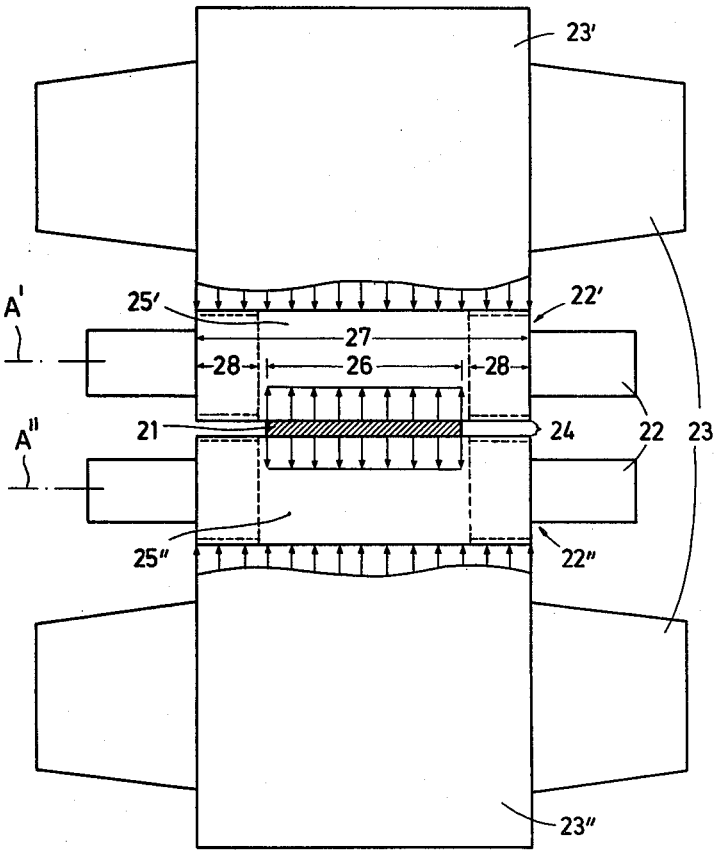
FIGS. 9 and 10 are views respectively like FIGS. 3 and 8 of another roll stand according to the invention.
Figure 10:
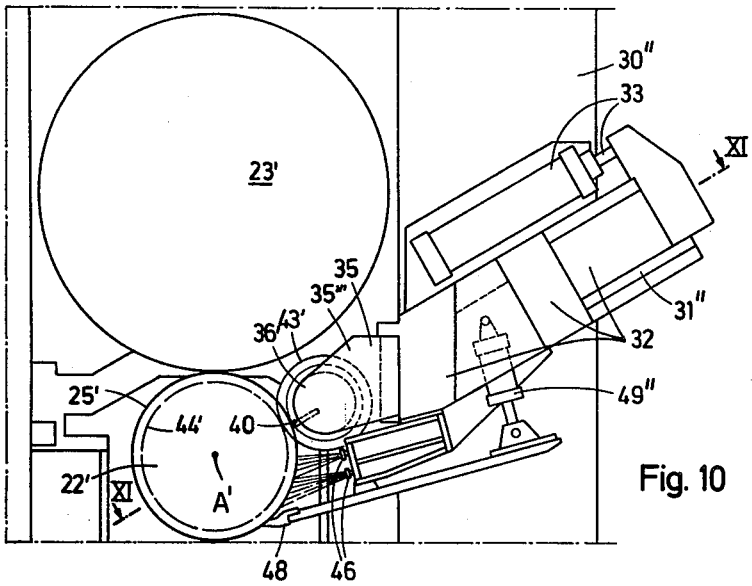
Figure 11:
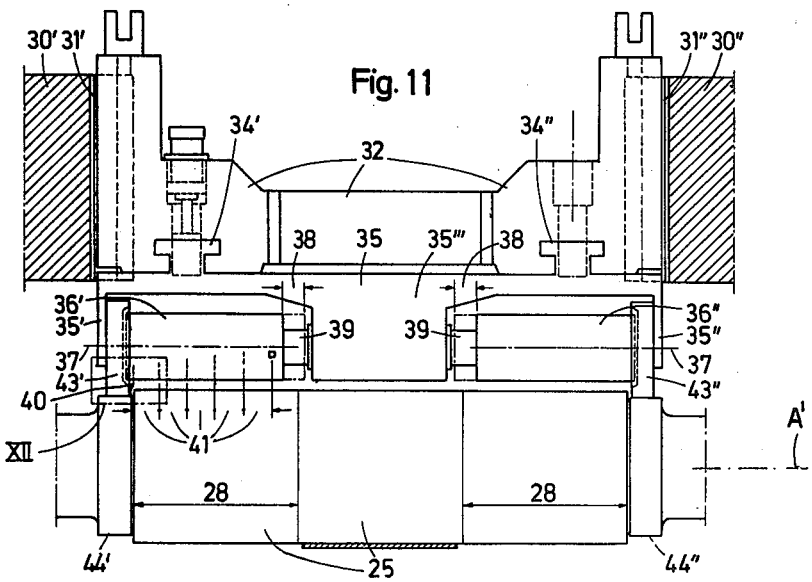
FIG. 11 is a section taken along line XI—XI of FIG. 10.

FIG. 8 shows another arrangement, with only the upper working and backing rolls 2' and 3' shown although it is understood that another such setup is provided for the lower rolls and for the other side of the upper rolls. Here the unit includes a grinder 10 carried on a traverse 12 and movable therealong by a screw 11. The traverse in turn is carried on a support 13 journaled for rotation about the axis of the respective working roll 3' and movable by a ram 14 to force the grinder 10 against the working roll 2'. A sprayer 16 and flexible scraper 15 prevent the shavings, chips, or the like from getting onto the workpiece where they would create intolerable inclusions.

In a standard such system the working rolls 2' and 2'' engage the backing rolls 3' and 3'' along a width of 2.240 m. The effective roll width is set at the workpiece width plus 2×50 mm. Using workpieces varying between 700 mm and 2080 mm wide superior results, that is more uniform workpiece thickness, was obtained, especially at the longitudinal edges, than has been possible hitherto with the known systems. In fact with the known systems as the difference between the effective roll width and the contact width increases the variation in workpiece thickness similarly increases. In addition the instant invention works well in combination with prior-art systems wherein the working rolls are bent, and when combined with such systems produce extremely good results. The bending force can be reduced to about one-seventh that normally used to obtain the same shape, so long as the contact width, which is equal to the workpiece width, does not vary by more than 50 mm to 100 mm from the effective roll width, that is the axial dimension between its cut-in end portions.

FIGS. 9–13 show an arrangement similar to those described above. A pair 22 of small-diameter working rolls 22' and 22'' is flanked by a pair 23 of respective large-diameter backing rolls 23' and 23'' roatatable about respective parallel axes coplanar with the axes A' and A''. The rolls 22' and 22'' define a nip 24 and have central portions 25' and 25'' of a starting width 27 that is reduced to effective widths slightly greater than the workpiece width 26 by cutting in its end regions 28 as described above.

The roll-stand frame has a pair of sides 30' and 30'' formed with inclined guides 31' and 31'' carrying a support 32 for movement radially down toward and up away from the roll 22'. In addition this support has guides 34' and 34'' for a traverse 35 having two outer ends 35' and 35'' as well as a center portion 35'''. An identical such arrangement is provided for the other roll 22''.

Respective tool holders 36' and 36'' are carried on the traverse between the ends 35' and 35'' and the center 35'''. They are generally cylindrical and rotatable about an axis 37 parallel to the axis A' and are each displaceable along this axis 37 through a stroke 38 on a common shaft 39 to which they are keyed for synchronous and joint rotation, normally through angular steps of 15° as will be described below. The axial actuator can be a simple fluid cylinder built right into the shaft 39. The length along the axis 37 of each such revolving support 36', 36'' is at least equal to the maximum end-region length 28.

Each tool carrier 36' and 36'' is provided with a plurality of identical tool bits 40 which are equidistantly offset at axial spacings 41 from each other as well as equiangularly about the axis 37 at spacings 42, here arranged on a helix centered on the axis 37. This spacing 42 is equal to the angular step through which the revolver-style supports 36' and 36'' are rotated or a whole-number multiple thereof. The spacing 41 is turn is slightly less than the stroke 38. It is possible to have several such sets of tools 40 at different spacings 41, so that with each machining operation a region of different axial length can be machined down.

In the illustrated arrangement the tools 40 are arranged in groups of six with a spacing 41 of 110 mm, whereas the stroke 38 is 120 mm. Thus the ends 28 can be machined over distances of 660 mm in six consecutive working operations.

Figure 12:
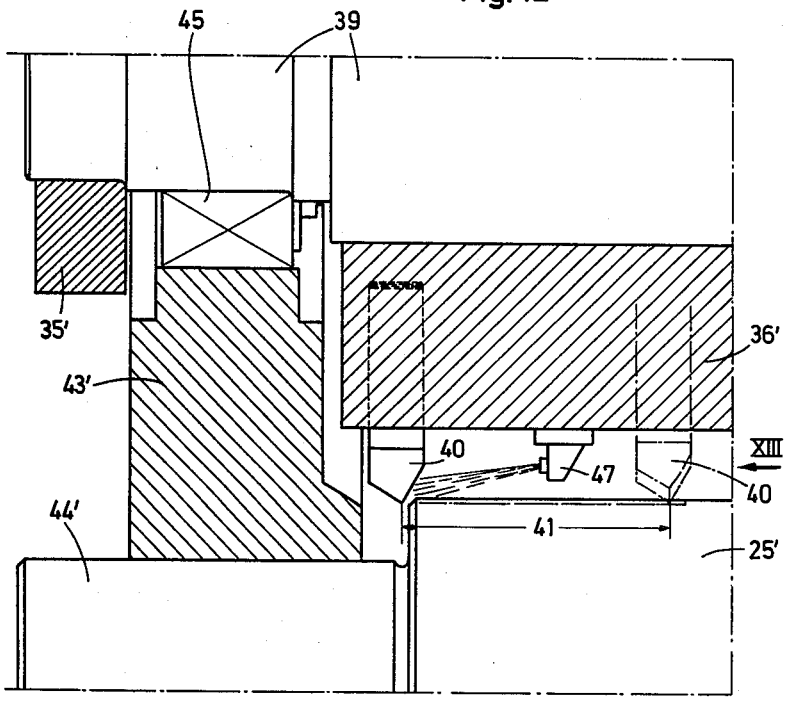
FIG. 12 is a large scale of the detail indicated at XII in FIG. 11.
Figure 13:
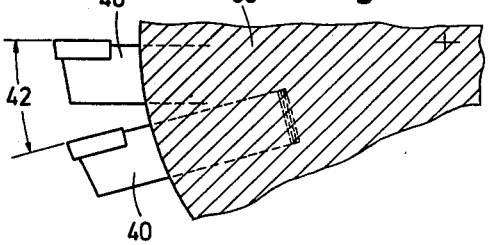
FIG. 13 is an end taken in the direction of arrow XIII of FIG. 12.

To make the first diameter reduction the holders 36' and 36'' are turned by another actuator which is connected between the shaft 39 and support 32 so the outermost tools 40 engage and cut the roll 22', and then they are moved inward from their outermost positions through the distance 38 while the roll 22' turns, traveling from the solid-line position of FIG. 12 to the dot-dash line position. This will lathe down the end regions 28. Thereafter the holders 36' and 36'' are moved out, away from each other. For the next reduction of the effective roll width the holders 36' and 36'' are turned through the angle 42 to bring the second-from-the-end tools 40 into engagement with the roll, and another 110–120 mm can be cut off each end. Subsequent use of successive tools allows 660 mm, as mentioned above, to be machined. Of course less than the maximum stroke 38 can be cut in any one operation if desired.

Rollers 43' and 43'' that are coaxial to the holders 36' and 36'' but freely rotatable and axially nondisplaceable on the axis 39 by means of bearings 45 are provided to position the tools 40 accurately relative to the roll 22'. These rollers 43' and 43'' act with cylindrically annular surfaces 44' and 44'' formed on the roll 22' and centered on the axis A'. Thus these rollers 43' and 43'' can contact these surfaces 44' and 44'' to establish the spacing of the axes 27 and A' with great accuracy, thereby ensuring that the depth of cut is extremely accurately maintained uniform. With this system the depth of cut is established right at the beginning, so that next time as the drive 33 pushes in the support 32 the same depth of cut is established. Since the guides 31' and 31'' extend perfectly radially of the axis A', the tools 40 will cut perfectly no matter what the diameter the roll 22' is.

To prevent chips from getting on the workpiece 21 sprayers 46 of a coolant/lubricant are provided. The tool supports 36' and 36'' are further provided with compressed-air nozzles 47 directed at the tools 40 parallel to the axis 37 so that chips are blown outward, away from the workpiece. In addition a flexible-edge plate 48 is urged by a cylinder 49 against the roll 22' to strip any chips or shavings from it.

Figure 14:
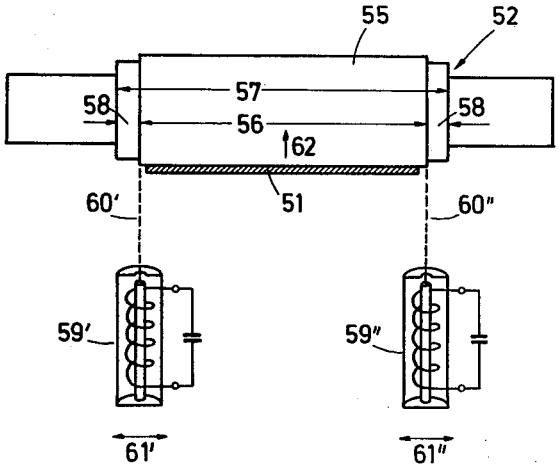
FIG. 14 is a small-scale view of another arrangement according to this invention.

FIG. 14 shows mainly diagrammatically a system for reducing the overall length 57 of the central portion 55 of a working roll 52 so as to cut in its end regions 58 and leave a cylindrical central region 56 to roll out a strip workpiece 51. Lasers 59' and 59'' form beams 60' and 60'' that are directed radially in direction 62 at the projecting end regions 58 while the units 59' and 59'' are reciprocated axially back and forth as shown by double-headed arrows 61' and 61''.

These units 59' and 59'' have a rating of between 5 kW and 12 kW so the beams are easily able to vaporize a metallic layer on the surface equal to between 0.1 mm and 1.8 mm to effect the diameter reduction according to the present invention. For deeper cutting it is necessary to make several passes with the beams 60' and 60''. The energy of the beams as well as their displacement are accurately controlled to produce the desired cut.

This laser system is not suitable for the refinishing of the roll, which must be done by conventional means to produce a sufficiently smooth surface. It is quite adequate to reduce the diameter according to this invention, and in fact does so in an extremely simple manner while subjecting the roll to no particular stress. The ledeburitic layer left, however, must be machined down before the roll can be reused. This arrangement can easily be built onto an existing roll stand.

We claim:

1. In a rolling method wherein in each of a succession of passes forming a single run a strip travels through a nip defined between a pair of parallel and nearly cylindrical working rolls braced against respective backing rolls so that with each pass the thickness and width of the strip are reduced, the ends of the working rolls projecting laterally beyond the longitudinal edges of the strip, the improvement comprising the step of:

reducing the diameters of the projecting ends of the working rolls several times after respective passes in a single run so that the working rolls only contact the respective backing rolls along a distance equal generally to the workpiece width.

2. The improved strip-rolling method defined in claim 1 wherein the rolls are mounted on a stationary roll stand for rotation about respective parallel axes as the strip passes between them, the diameters of the working rolls being reduced by machining of the working rolls while same rotate about their axes on the roll stand.

3. The improved strip-rolling method defined in claim 2 wherein the ends are machined by means of laser beams directed at the working rolls to vaporize the surfaces of the projecting ends thereof.

4. The improved strip-rolling method defined in claim 2 wherein the projecting ends are machined while the working rolls are in contact with the strip in the nip.

5. The improved strip-rolling method defined in claim 2 wherein the ends are machined by engaging a hard material-removing tool against them.

6. The improved strip-rolling method defined in claim 5 wherein the ends are machined by engaging the tool radially against them and then moving the tool axially along the projecting-end region whose diameter is to be reduced, whereby the ends are machined to cylindrical shape.

7. The improved strip-rolling method defined in claim 5 wherein the roll stand is provided adjacent each projecting end with a tool holder rotatable about an axis parallel to the respective working-roll axis and provided with a plurality of axially and radially spaced tools, each end being machined by engagement with one of the respective tools, method comprising the step of rotating the holders between machining operations to bring successive tools into engagement with the respective end regions.

8. The improved strip-rolling method defined in claim 2 wherein the end portions are machined to cylindrical shape centered on the respective axes and after each such run the central region of each roll between the machined-down end regions is machined down to the same diameter as the end regions.

9. The improved strip-rolling method defined in claim 2 wherein the end portions are machined to cylindrical shape centered on the respective axes to a radial depth of between 0.05 mm and 0.9 mm.

* * * * *